US007810586B2

(12) United States Patent
Cousins et al.

(10) Patent No.: US 7,810,586 B2
(45) Date of Patent: Oct. 12, 2010

(54) SECTIONAL DRIVE AND COUPLING SYSTEM

(76) Inventors: James E. Cousins, 1904 Horton Ave., Shreveport, LA (US) 71105; Ruben C. Boyter, 9400 Dean Rd., Shreveport, LA (US) 71118

( * ) Notice: Subject to any disclaimer, the term of this patent is extended or adjusted under 35 U.S.C. 154(b) by 121 days.

(21) Appl. No.: 12/313,073

(22) Filed: Nov. 17, 2008

(65) Prior Publication Data

US 2009/0127000 A1 May 21, 2009

Related U.S. Application Data

(60) Provisional application No. 61/003,584, filed on Nov. 19, 2007.

(51) Int. Cl.
*E21B 17/00* (2006.01)
*F16D 3/18* (2006.01)
*F16D 3/44* (2006.01)

(52) U.S. Cl. ..... 175/101; 175/320; 464/157

(58) Field of Classification Search ..... 464/19, 464/18, 157, 158, 149; 175/61, 62, 101, 175/320

See application file for complete search history.

(56) References Cited

U.S. PATENT DOCUMENTS

| | | | | |
|---|---|---|---|---|
| 1,367,042 A | | 2/1921 | Granville | |
| 1,860,762 A | | 5/1932 | Wyrick | |
| 2,516,421 A | | 7/1950 | Robertson | |
| 2,539,047 A | | 1/1951 | Arutunoff | |
| 2,684,581 A | * | 7/1954 | Zublin | 464/19 |
| 2,726,847 A | | 12/1955 | McCune et al. | 175/61 |
| 2,778,603 A | | 1/1957 | McCune et al. | 175/61 |
| 2,779,570 A | | 1/1957 | Roper | |
| 3,667,556 A | | 6/1972 | Henderson | 175/73 |
| 3,733,853 A | * | 5/1973 | Sutliff et al. | 464/19 |
| 3,903,974 A | | 9/1975 | Cullen | 175/17 |
| 3,958,649 A | | 5/1976 | Bull et al. | 175/61 |
| 4,051,908 A | | 10/1977 | Driver | 175/78 |

(Continued)

*Primary Examiner*—William P Neuder
*Assistant Examiner*—Cathleen R Hutchins
(74) *Attorney, Agent, or Firm*—John M. Harrison

(57) ABSTRACT

A sectional drive and coupling system for transmitting rotational power to an output, which system includes multiple, splined drive and receiving segments that are connected, nested and interlocked in the ends of successive segment housings to define a drive string that is rotatable in a selected straight or curved path. The top one of the segments cooperates with a drive mechanism to effect rotation of the drive string in concert and the bottom one of the segments connects to an output such as a drill bit. Multiple, tapered and truncated exterior splines on the drive segments mesh with complementary interior splines on the adjacent receiving segments in the segment housings to enable slight angular positioning of the sets of drive and receiving segments on each other and facilitate dampening of drive vibration and bending of the drive string in or out of the chosen path in any desired direction as the drive string transmits rotational power in a curved path of desired magnitude from the drive mechanism to the output. The drive and receiving segments are typically connected internally by a bolt, nuts and belleville springs at the ends of the housings to form the drive string. In one embodiment a drill bit is mounted on the bottom one of the segments on the drive string for interval drilling. In another embodiment a selected number of drive and receiving segments and connected segment housings replace the flexible drive shaft coupling in a mud motor.

10 Claims, 4 Drawing Sheets

U.S. PATENT DOCUMENTS

| | | | | |
|---|---|---|---|---|
| 4,185,705 | A | 1/1980 | Bullard | 175/78 |
| 4,187,698 | A * | 2/1980 | Ohlson | 464/157 |
| 4,368,786 | A | 1/1983 | Cousins | 175/78 |
| 4,442,908 | A | 4/1984 | Steenbock | 175/74 |
| 4,456,080 | A | 6/1984 | Holbert | 175/61 |
| 4,601,353 | A | 7/1986 | Schuh et al. | 175/41 |
| 4,625,815 | A | 12/1986 | Spies | 175/73 |
| 4,658,916 | A | 4/1987 | Bond | 175/81 |
| 4,699,224 | A | 10/1987 | Burton | 175/61 |
| 4,880,667 | A | 11/1989 | Jelsma | 175/107 |
| 4,976,655 | A | 12/1990 | Hebert, Sr. | 464/16 |
| 5,135,060 | A | 8/1992 | Ide | 175/107 |
| 5,337,839 | A | 8/1994 | Warren et al. | 175/62 |
| 5,363,929 | A | 11/1994 | Williams et al. | 175/107 |
| 5,373,906 | A | 12/1994 | Braddick | 175/67 |
| 5,392,858 | A | 2/1995 | Peters et al. | 166/98 |
| 5,413,184 | A | 5/1995 | Landers | 175/62 |
| 5,699,866 | A | 12/1997 | Cousins et al. | 175/78 |
| 5,727,641 | A | 3/1998 | Eddison et al. | 175/76 |
| 5,911,283 | A | 6/1999 | Cousins et al. | 175/78 |
| 6,265,648 | B1 * | 7/2001 | Steinberger | 84/293 |
| 6,523,624 | B1 | 2/2003 | Cousins et al. | 175/386 |
| 2004/0040751 | A1 | 3/2004 | Falvey et al. | 175/415 |

* cited by examiner

SECTIONAL DRIVE AND COUPLING SYSTEM

CROSS-REFERENCE TO RELATED APPLICATIONS

This application claims the benefit of and incorporates by reference U.S. Provisional Application Ser. No. 61/003,584, Filed Nov. 19, 2007.

BACKGROUND OF THE INVENTION

Summary of the Invention

Conventional techniques for effecting the transmission of rotational power between a power source and an output under circumstances where the power is to be transmitted in an offset or curved manner, includes the use of coupling mechanisms such as a universal or "CV" joints which are well known to those skilled in the art. For example, many devices have been designed for lowering into an oil or gas well for the purpose of boring and drilling holes at right angles to the well bore at the production interval, but many problems have been encountered using these systems. Typically, the relatively low bit rotational speed generally necessitated by using curved shafts of various design sometimes requires excessive time to achieve significant penetration, and increasing the bit rotational speed and torque load frequently causes failure of the shafts. Accordingly, these conventional horizontal drilling devices have not proved capable of sustaining the high compressive loads necessary to penetrate the well casing, concrete sheath, rock and producing interval in a well within an economical time frame without failure. Other problems have been encountered, such as impediments to bit retrieval and reduced freedom of rotation of the drill string in such application.

This invention relates to drive and coupling systems for transmitting rotational power to an output and more particularly, to a sectional drive and coupling system which is characterized by connected multiple, splined, interlocking drive and receiving segments seated in the facing ends of a string of linearly-aligned segment housings. The interior-tapered drive segments include truncated and tapered exterior splines extending from a segment base and the receiving segments have interior splines extending from a companion segment base for receiving the exterior splines of the drive segment in a series or string of the segment housings. Interior spline seats on the receiving segments are located between the interior splines and are substantially complementary to the configuration of the exterior splines on the opposed sets of drive segments. The drive and receiving segments are thusly nested and interlocked at the ends of the respective linearly-aligned segment housings by inserting the exterior splines of one set of drive segments in the respective congruent interior spline seats between adjacent interior splines of the adjacent sets of receiving segments and bolting the segment sets together in the ends of the drive housings using spherical bearings and belleville springs. The resulting drive system can be rotated as a drive string in a selected path in one embodiment, to drill openings in down-hole oil and gas intervals. The drilling path may be straight or curved and in the latter case, the interlocking drive and receiving segments and associated segment housings are capable of slight angular shifting on each other against the tension in the belleville springs, while maintaining a drive configuration of high integrity. In another embodiment, this mechanical arrangement allows the segmented drive string to dampen drive vibration, as in a mud motor, for example, and to define a chosen curved drive path and facilitate transmission of rotation from a drive mechanism to an output device, with the application of considerable torque and thrust. The respective nested drive and receiving segment sets are typically threaded in the ends of the respective linearly-aligned segment housings and are interconnected by the bolt, nuts, spherical bearings and belleville springs in a selected compressive force. The resulting tool string can therefore be used as a drive train in any application in which a transfer of rotation is required in a straight line or at an angle or deviation from a straight line. The sectional drive and coupling system is therefore ideally suited to effect horizontal drilling or coring of producing hydrocarbon intervals in oil and gas wells, utilizing the multiple, stacked and tapered, housing-mounted interlocking drive segments, driven by a downhole drilling motor, power swivel, top drive or rotary table at one end of the drive string to operate a drill bit connected to the opposite end of the drive string. Retrieval of the drive string from the interval is facilitated by the connection of the respective interlocking drive and receiving segments together at the respective bolts. Consequently, the sectional drive and coupling system of this invention can be used in a downhole drilling apparatus to more efficiently effect drilling deviation in a controlled manner from a vertical well bore and provide a primary horizontal deviation or a lateral deviation from an existing vertical well bore. In one application a drill bit is mounted on the bottom one of the drive segments on the drive string and is characterized by multiple interior splines which engage the companion exterior splines of the drive segment.

While capable of being operated in an efficient manner to permit horizontal or angular drilling of drain hole perforations in oil wells, the sectional drive and coupling system of this invention can also be implemented to transmit rotational power from substantially any drive system to an output apparatus, drive or other system, such as a mud motor, under circumstances where the rotational power is to be transmitted in an offset or a curved line. Accordingly, the sectional drive and coupling system is preferably designed with truncated drive and receiving segments and is capable of being used to transmit rotation from an engine, motor or other power source to automobiles, mud motors and like apparatus and equipment, as well as to dental drills, various robotic devices and material-handling equipment, in non-exclusive particular.

Accordingly, the invention includes a new and improved sectional drive and coupling system for transmitting rotational power from a drive source or apparatus of selected character to an output device of selected design under circumstances where the drive apparatus and the output device are misaligned or can become misaligned. The multiple, internally tapered, splined and interlocking drive segments typically include eight, spaced-apart, asymmetrical, tapered and truncated exterior splines extending from one surface of a round base, each having an exterior spline seat, a drive face and an angular spline support face of unequal area and enclosed in one end of respective aligned segment housings. Interior splines extend from the base of the companion receiving segments secured in the opposite ends of the aligned segment housings and define interior spline seats between the interior splines for receiving the congruent or complementary exterior splines of the facing adjacent drive segments in driving relationship to facilitate articulation between the respective housing segments. The drive and receiving segments are typically bolted together in sets in the aligned ends of the corresponding segment housings, typically with associated spherical bearings and cupped belleville springs in a concave surface-to concave surface, single or stacked configuration, to create a desired tension. This spherical bearing and belleville spring configuration, together with the internal taper in the drive segments, facilitates a selected degree of articulation at each joint in the segment housings as a selected number of the segments are stacked and nested in spaced-apart, rotatable relationship to define a rotatable drive string, one end of which drive string is attached to a drive mechanism and the opposite end to an output device.

BRIEF DESCRIPTION OF THE DRAWINGS

The invention will be better understood by reference to the accompanying drawings, wherein.

DESCRIPTION OF THE PREFERRED EMBODIMENTS

Figure 1:
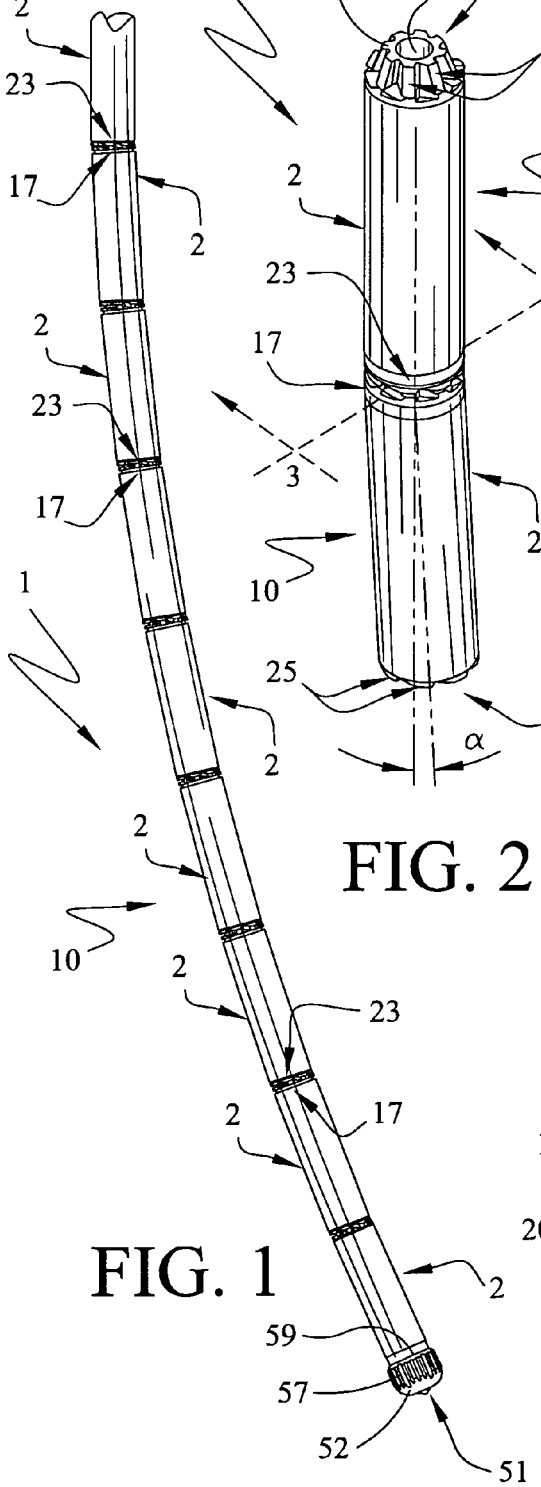
FIG. 1 is a side view of a drive string of a typical sectional drive and coupling system of this invention which may be connected at one end to a suitable drive apparatus for rotating the entire segment string and a drill bit provided on the opposite end of the drive string.
Figure 2:
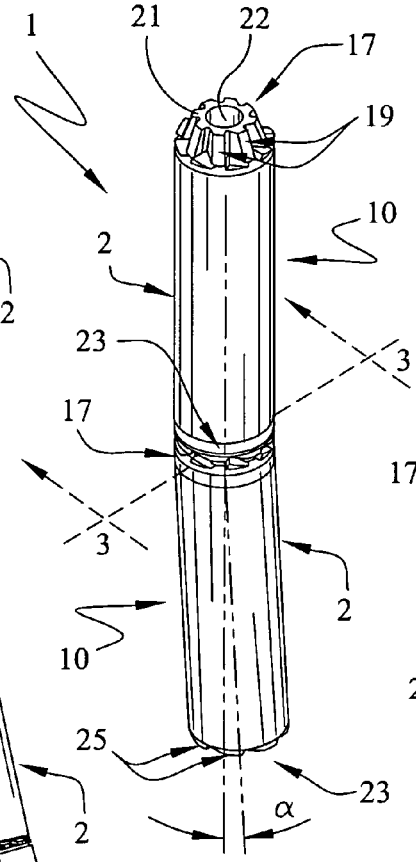
FIG. 2 is a side view of a typical pair of connected sectional drive and coupling system components, more particularly illustrating drive and receiving segments of the drive string partially enclosed in respective aligned segment housings.
Figure 3:
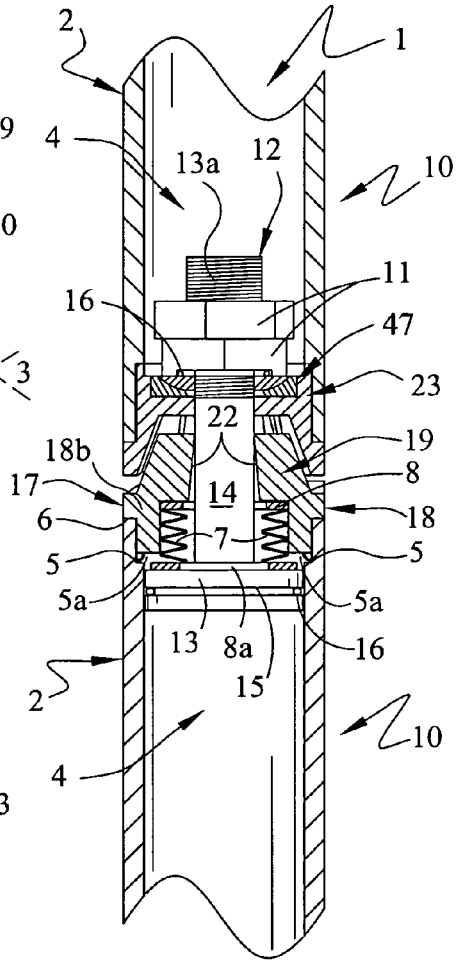
FIG. 3 is a sectional view taken along line 3-3 of the drive and receiving segments illustrated in FIG. 2.
Figure 4:
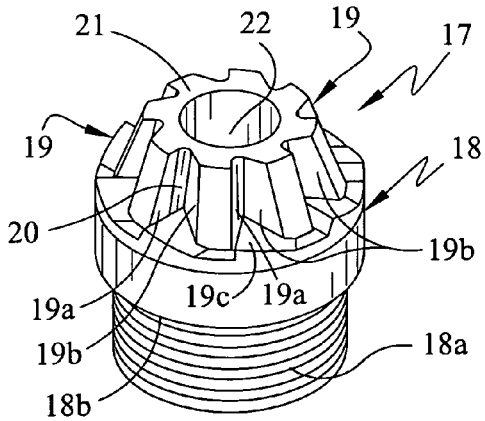
FIG. 4 is a perspective view of the top drive segment illustrated in FIG. 2, more particularly illustrating the exterior splines and intervening exterior spline seats and the segment aperture of the drive segment.
Figures 5, 6, 7, 8:
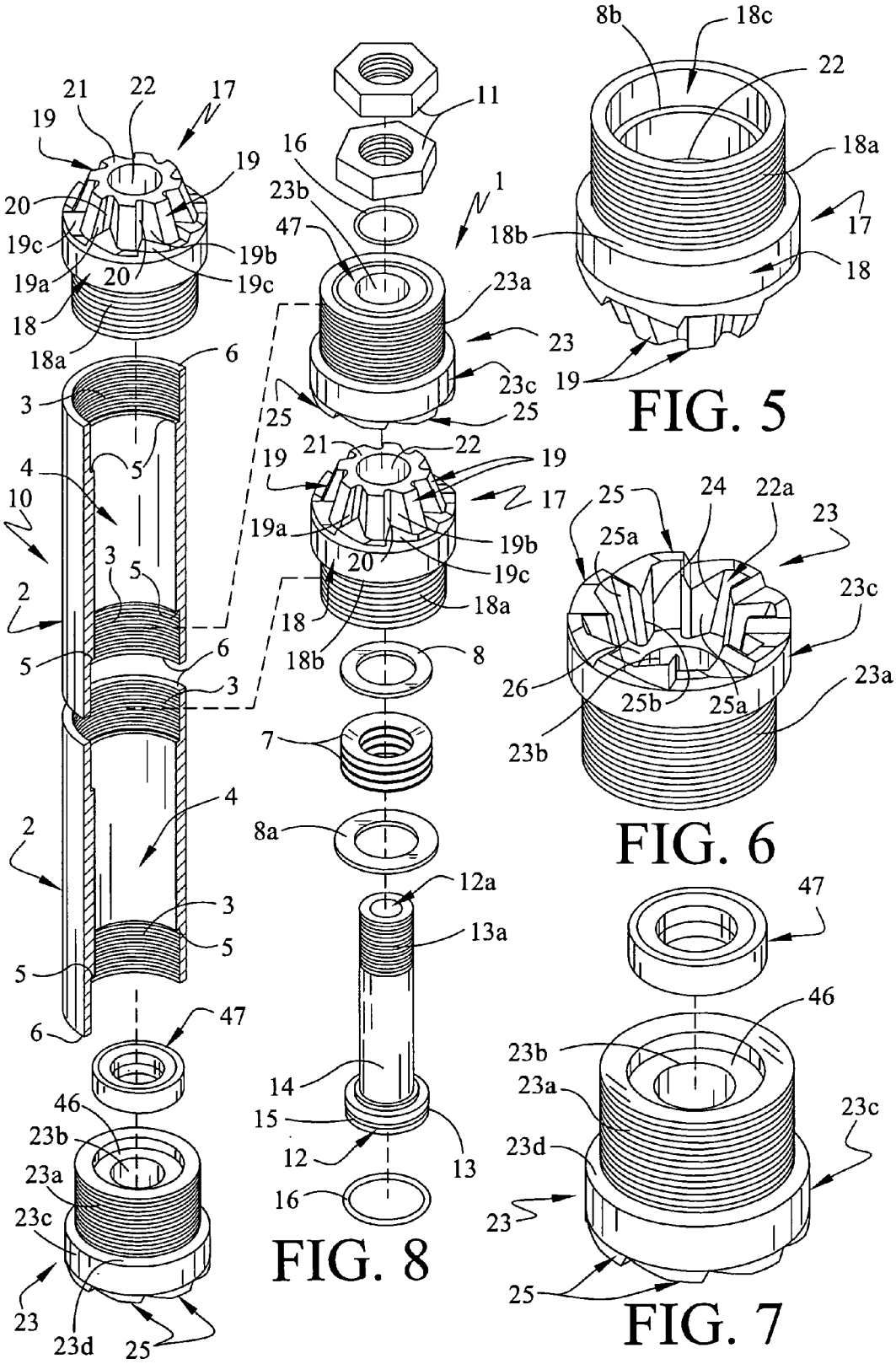
FIG. 5 is a perspective view of the drive segment 180-degrees reversed from the position illustrated in FIG. 4, more particularly illustrating the threaded segment base and segment aperture of the drive segment.
FIG. 6 is a perspective view of the bottom receiving segment 180-degrees reversed from the position illustrated in FIG. 2.
FIG. 7 is a reverse perspective view of the sectional drive system illustrated in FIG. 6, more particularly illustrating the segment aperture therein.
FIG. 8 is an exploded view of the sectional drive system drive and receiving segment components illustrated in FIG. 2, including bolt, connecting nuts and belleville spring components.

Referring initially to FIGS. 1-8 of the drawings, the sectional drive and coupling system of this invention is generally illustrated by reference numeral 1. The sectional drive and coupling system 1 is characterized by a drive and coupling string 10, formed by mounting multiple, splined drive segments 17 and receiving segments 23 in facing sets in the ends of respective segment housings 2, as illustrated in FIGS. 1 and 2. Each of the drive segments 17 includes a flat, disc-shaped segment base 18 and multiple tapered, truncated, asymmetrical exterior splines 19 extending from a flat front base surface 19*c* of the segment base 18, as illustrated in FIGS. 4 and 8. In a typical embodiment of the invention each of the drive segments 17 is shaped to include eight exterior splines 19, each having a drive face 19*a* and an angular spline support face 19*b*. The exterior splines 19 define eight intervening exterior spline seats 20 in a repetitive, geometric pattern which resembles an eight-point star when viewed from the front, as further illustrated in FIG. 4. The segment base 18 defines a segment base shoulder 18*b*, lying adjacent to the segment base threads 18*a*, as illustrated in FIG. 5. The exterior splines 19 taper from the front base surface 19*c* to a flat, truncated tip 21, which is coplanar with the converging sets of exterior splines 19, and a tapered tip aperture 22 is typically provided in the center of the tip 21, and extends through the segment base 18, as illustrated in FIGS. 3, 4 and 5. A segment base cavity 18*c* and lower spring washer seat 8*b* are provided inside the receiving segment threads 23*a*, as illustrated in FIG. 5.

Referring again to FIGS. 6, 7 and 8 of the drawings, the receiving segments 23 include multiple interior splines 25, extending from a flat tip seat 26 of the receiving segment base 23*c*, to define a central segment interior 22*a*. As illustrated in FIG. 6, each of the interior splines 25 is typically characterized by a flat drive face 25*a* and a flat spline wall 25*b*. An interior spline seat 24 is defined between adjacent interior splines 25 and the interior splines 25 of the receiving segments 23 substantially conform to the taper angle of the exterior splines 19 in the companion drive segments 17. Moreover, the exterior splines 19 of the drive segments 17 are complementary in shape to the interior spline seats 24 of the nesting receiving segments 23 and the interior splines 25 are complementary in shape to the exterior spline seats 20, respectively. Accordingly, the drive segments 17 will nest in, stack and interlock with the companion receiving segments 23 and yet are capable of being positioned at an angle alpha on each other in driving relationship to shape the drive string 10 as illustrated in FIGS. 1 and 2, with the respective nested exterior splines 19 of one drive segment 17 inserted in the interior spline seats 24 respectively, of respective adjacent and facing drive receiving segments 23. This interlocking registration of the drive segments 17 and receiving segments 23 is not rigid, but permits a pivoting or rocking movement of the drive segments 17 and receiving segments 23 in the interlocking and nested configuration, such that the drive and coupling string 10 can easily bend to conform to the curvature illustrated in FIG. 1 and yet maintain an interlocking, driving relationship of high integrity due to matching of the drive faces 19*a* of the exterior splines 19 in the drive segments 17, to the interior drive faces 25*a* of the interior splines 25 in the companion receiving segments 23. This articulating and interlocking registration of the drive segments 19 and receiving segments 23 also serves to dampen any excessive vibration of such devices as mud motors (not illustrated) or other drive mechanisms (not illustrated) at the input of the drive string 10, as hereinafter further described.

Referring again to FIGS. 1-8 of the drawings, each set of the drive segments 17 and interlocking receiving segments 23, fitted with spherical bearings 47 inserted in spherical bearing seats 46 (FIG. 7) are seated in corresponding ends of linearly-aligned segment housings 2 of selected length and wall thickness. In a typical embodiment the drive segments 17 are fitted with segment base threads 18*a* that thread into corresponding segment housing threads 3 provided in each end of each segment housing 2, as illustrated in FIG. 8. In similar manner, each of the receiving segments 23 is fitted with receiving segment threads 23*a* that lie adjacent to a receiving segment base shoulder 23*d*, and fit in opposite ends of the segment housings 2 from the drive segments 17, at the corresponding segment housing threads 3. In this manner, opposing and interconnecting sets of the drive segments 17 and the receiving segments 23 can be mounted in the ends of complimentary segment housings 2 as illustrated in FIG. 3, to facilitate interlocking, yet articulating connection of the respective segment housings 2. Securing of the respective sets of drive segments 17 and receiving segments 23 together in the respective aligned segment housings 2 at the respective segment housing ends 6 is typically effected by connecting bolts 12, each having a connecting bolt head 13, positioned in the segment housing bore 4 of one of the segment housings 2. The connecting bolt shank 14 of each connecting bolt 12 extends through the aligned tapered tip aperture 22 and receiving segment aperture 23*b* provided in the respective engaged drive segments 17 and receiving segments 23, respectively. A pair of connecting bolt nuts 11 are typically threaded on the connecting bolt threads 13*a* of the connecting bolt shank 14 against each spherical bearing 47 seated in the corresponding receiving segment 23 in the adjacent aligned segment housing 2, as further illustrated in FIG. 3. An O-ring seat 15 is typically provided on the connecting bolt head 13 to receive a companion O-ring 16 and seal the connecting bolt head 13 (FIG. 8) in the segment housing 2. The second or outside one of the connecting bolt nuts 11 typically serves as a lock nut to facilitate securing both of the connecting bolt nuts 11 on the connecting bolt threads 13*a* and the inside connecting bolt nuts 11 against the respective spherical bearings 47. Interposed between the connecting bolt head 13 and the segment base 18 in the segment base cavity 18*c* of each of the drive segments 17 are several belleville springs 7 (FIG. 3), that typically fit against a corresponding upper spring washer 8 and a larger lower spring washer 8*a*, as illustrated in FIGS. 3 and 8 of the drawings. In a preferred arrangement, the belleville springs 7 are positioned such that the concave or cupped faces of one or more outside springs lie against the flat, typically hardened, ground and polished faces of the corresponding upper spring washer 8 and lower spring washer 8*a*, respectively, to facilitate a reduced friction contact between the concave side of each of the outside belleville springs 7 and the corresponding upper spring washer 8 and lower spring washer 8*a*. The upper spring washer 8 is seated against the belleville springs 7 and on the lower spring washer seat 8*b* (FIGS. 3 and 5) in the segment base 18 of each drive segment 17. The lower spring washer 8*a* is seated against the connecting bolt head 13 of the connecting bolt 12 and the belleville springs 7, adjacent to a shoulder space 5*a* at the segment shoulders 5, as illustrated in FIG. 3. This mechanical arrangement allows selective flexure of the belleville springs 7 upon tightening of the connecting bolt nuts 11 on the connecting bolt threads 13*a* of the corresponding connecting bolt shank 14 to a selected torque, thus varying the clearance in the shoulder space 5*a*, as further illustrated in FIG. 3 of the drawings. The interior belleville springs 7 are fitted against each other in sets of two or more in selected assemblies at the respective cupped or concave faces, to allow flexure and facilitate the desired spring tension in the segment connection. The segment shoulder 5 on each of the drive segments 17 creates a stop surface for the lower spring washer 8*a* that is seated against the connecting bolt head 13 in a spaced-apart clearance from the bottom end of the segment base 18 of the adjacent drive segment 17 at the shoulder space 5*a*. The shoulder space 5*a* allows variable tensioning of the belleville springs 7 by selectively tightening and loosening the connecting bolt nuts 11 to a desired torque, and thus facilitates adjusting the degree of articulation or flexure of the drive segment-receiving segment interconnection at the respective ends of the segment housings 2.

Accordingly, referring again to FIGS. 1 and 3 of the drawings, when a selected number of the segment housings 2 of the sectional drive and coupling system 1 are connected in a drive and coupling string 10 as illustrated in FIGS. 1 and 3, the entire sectional drive and coupling system 1 is able to flex and define a curvature such as that illustrated in FIG. 1, because of the selected flexure provided in each of the joints at the corresponding shoulder spaces 5*a* in the respective interconnection of the corresponding drive segments 17 and receiving segments 23. Aiding this flexure are the respective spherical bearings 47 and the tapered tip apertures 22 in the drive segments 17. As described above, this curvature can be adjusted by controlling the tension applied to the respective belleville springs 7 in each of the interconnected drive segments 17 and receiving segments 23, at the shoulder spaces 5*a*, which tension is selectively adjusted by tightening and loosening the connecting bolt nuts 11 on the connecting bolt threads 13*a* of the corresponding connecting bolt shanks 14.

Figure 9:
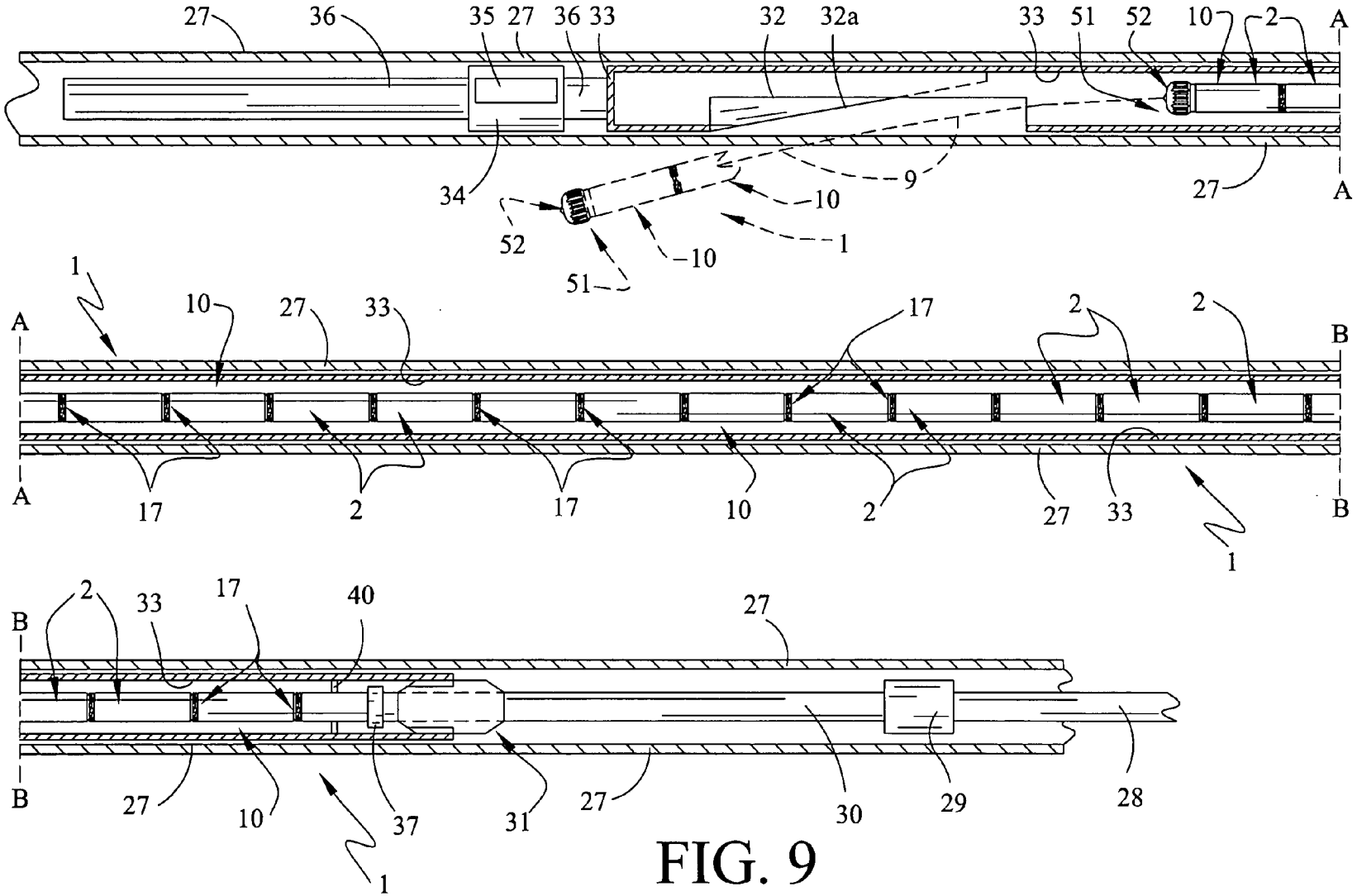
FIG. 9 is a longitudinal sectional view of a typical well casing, more particularly illustrating a typical tool body and internal whipstock, along with a drill bit on the drive string of the sectional drive and coupling system interposed inside the tool body in a drilling configuration of the invention.

Referring now to FIG. 9 of the drawings, in one embodiment the sectional drive and coupling system 1 of this invention can be utilized to drill production openings in various oil and gas intervals by initialing placing the segment housing 2 string in a tool body 33, typically fitted with a whipstock 32, having a concave surface 32*a* of selected curvature. The tool body 33 is lowered into a casing 27 using suitable equipment known to those skilled in the art, including a top drive shaft 30 and a length of tubing 28. An anchor body 34 may be fitted with anchor slips 35 and an anchor bar 36 is typically suspended from the anchor body 34 and is attached to the tool body 33. The top drive shaft 30 is typically connected to the tubing 28 at a coupling 29 and a top lock 31 serves to secure the tool body 33 to the top drive shaft 30. A top lock assembly 37 is typically provided on the top end of the sectional drive and coupling system 1 for engaging a catch mandrel 40, secured to the tool body 33, to stabilize the sectional drive and coupling system 1 inside the tool body 33. Accordingly, the tubing 28 can be rotated by a suitable drive system known to those skilled in the art to also rotate the sectional drive and coupling system 1 inside the tool body 33. When downward weight is applied to the tubing 28 and the top drive shaft 30, the drive and coupling string 10 is forced outwardly against the casing 27 by contact with the concave surface 32*a* at the whipstock 32, as illustrated in phantom. Continued rotation of the drill bit 51 causes the drill bit 51 to cut through the casing 27 and facilitates extension of the drive and coupling string 10 of the sectional drive and coupling system 1 outwardly into an interval (not illustrated) at a selected predetermined curvature, as illustrated in FIG. 1 and FIG. 9. Accordingly, a borehole can be drilled through the interval at a selected angle with respect to the casing 27 by continued downward rotatable pressure applied to the drive and coupling string 10 at the tubing 28. Retrieval of the drive and coupling string 10 from the interval and into the tool body 33 can be achieved by pulling the tubing 28 upwardly, while rotating it in the clockwise direction when viewed from above and applying steady tension to the tubing 28 and thus to the top drive shaft 30 and the drive and coupling string 10, to lift the sectional drive and coupling system 1, including the tool body 33, from the casing 27.

It will be further appreciated by those skilled in the art that other applications of the sectional drive and coupling system 1 may include the application of torque and thrust in a straight line or along a deviation from a straight line up to or even beyond ninety degrees, wherein the drive segments 17 and companion receiving segments 23 shift or pivot on each other in any desired direction. Torque may also be applied to the drive segments 17 and interlocking receiving segments 23 as the latter lie in a curved guide tube or path (not illustrated), as desired. Accordingly, typical of these applications, include replacement of the "CV" joints and mechanical couplings in mud motors and other applications involving misaligned drive and driven systems. Application of the invention to dental drills may also be effected under circumstances where the dental drill drive train must be curved over a selected adjustable or fixed radius from the drive motor to the application or drill end. The device may also be used in tools such as flexible-shaft screwdrivers and similar applications, in non-exclusive particular.

Figure 10:
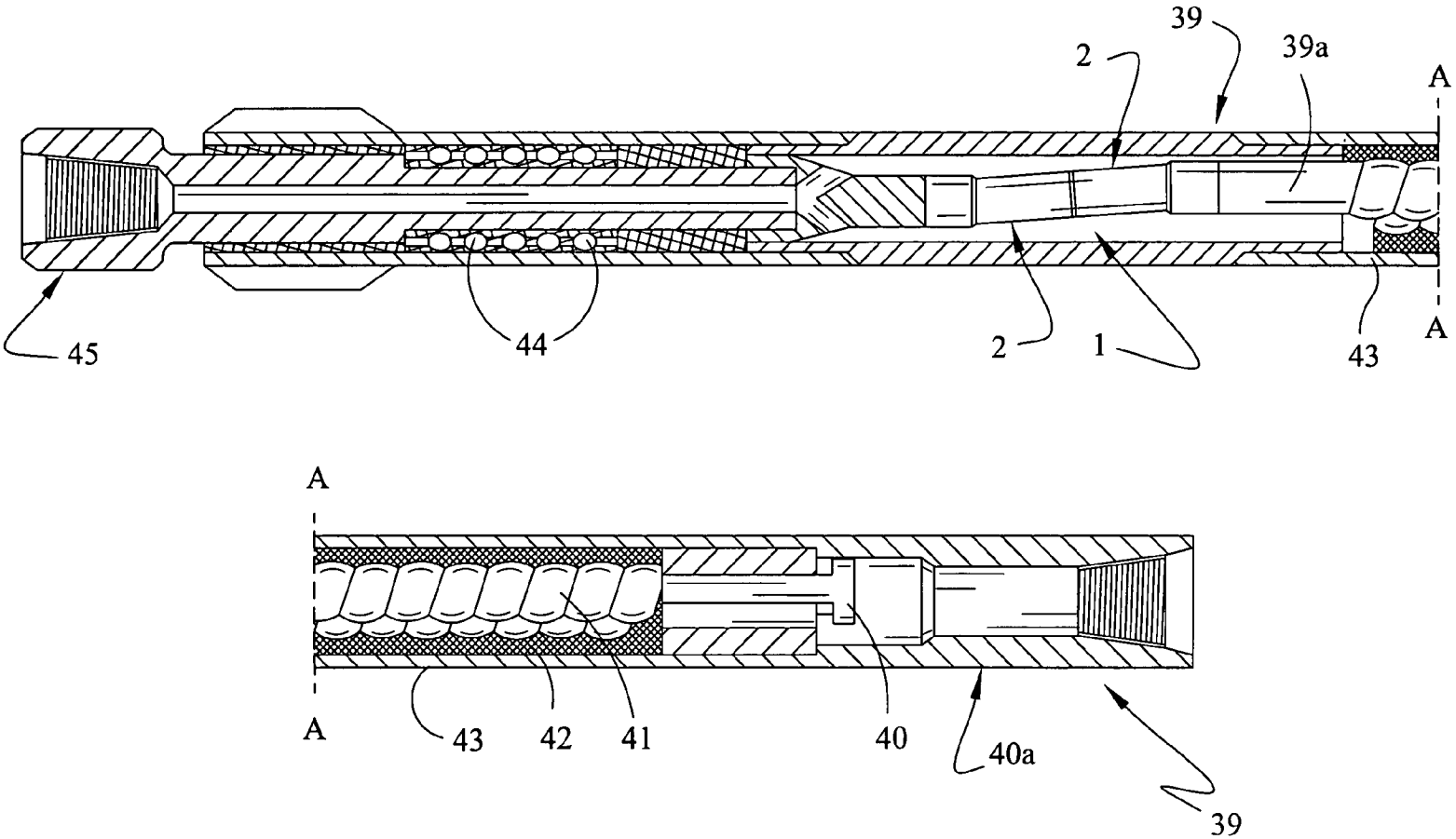
FIG. 10 is a sectional view of a typical mud motor, more particularly illustrating application of the sectional drive and coupling system of this invention to the power transmission section of the mud motor.

Referring now to FIG. 10 of the drawings, a typical mud motor 39 is illustrated and includes a top sub 40*a*, with an internal rotor 41 and external stator 42 enclosed in a stator housing 43. Thrust bearings 44 are provided in conventional fashion and a bit box 45 is located at the bottom end of the mud motor 39 for attachment of a drilling bit (not illustrated). Three of the segment housings 2 are fitted inside the mud motor 39 as indicated and connect the drive shaft 39*a* to the rotating element of the mud motor 39. Accordingly, the segment housings 2 and associated sets of the engaged drive segments 17 and receiving segments 23 serve to centralize eccentric motion due to the stator drive shaft 39*a*, the rotor 41 and the mud motor rotating component attached to the bit box 45. Articulation of the respective engaged drive segments 17 and receiving segments 23 at the interfaces of the respective segment housings 2 compensates for this eccentricity and facilitates application of considerable torque to the drive shaft 39*a* for transmission to the rotating element of the mud motor 39 and the bit box 45, over a long service life with minimum maintenance necessary to the mud motor 39.

It will be appreciated by those skilled in the art that the drive segments 17 and receiving segments 23 of this invention can be constructed of substantially any desired material, depending upon the desired application. Furthermore, the respective drive and receiving segments are typically applied where the deviation, offset or curve between the input and the output ends of the drive and coupling string 10 is significant. Moreover, the drive and coupling string 10 can be constructed to facilitate winding on a drum as in the case of coiled tubing, wherein the drive string 10 can be directed into a well from the drum in a quick and efficient manner.

Referring again to FIGS. 4-8 of the drawings, it will be further appreciated by those skilled in the art that substantially any number of exterior splines 19, exterior spline seats 20, interior spline seats 24 and interior splines 25 can be provided in the design of the drive segments 17 and receiving segments 23, respectively. However, in a typical embodiment of the invention eight exterior splines 19 and exterior spline seats 20, as well as eight matching interior spline seats 24 and interior splines 25 are provided in the drive segments 17 and receiving segments 23, as illustrated. The taper of the respective eight exterior splines 19 and the configuration of the interior splines seats 24 are complementary, as heretofore described, and the exterior splines 19 are typically about two percent to about five percent smaller than the interior spline seats 24, for optimum smoothness and meshing during bending of the drive and coupling string 10 while operating the sectional drive and coupling system 1 typically as illustrated in FIGS. 1 and 9.

Referring to FIGS. 3 and 8 of the drawings, it will be appreciated that the respective drive segments 17 and receiving segments 23 can be connected by the connecting bolts 12 without the use of belleville springs 7. However, either belleville springs or coil springs may be used to adjust the flexure of the drive and coupling string 10 by varying the width of the shoulder space 5*a* due to the tension applied by the connection bolts 12.

It will be further appreciated by those skilled in the art that drilling fluid (not illustrated) can be continuously circulated through the drive string 10 and attached drill bit 51 during operation of the sectional drive system 1 in a drilling application, for purposes of cooling and preventing accumulation of drilling fragments in the drive string 10 and drill bit 51. Accordingly, the drilling fluid (not illustrated) is injected into the drive and coupling string 10 in any convenient manner and flows through the respective connecting bolt apertures 12*a* of the corresponding connecting bolts 12 of the sets of top input drive sections 17 of the drive string 10 and then through the respective intervening segment housing bores 4 connecting the drive segments 17 and the respective corresponding interlocking receiving segments 23. The drilling fluid then typically enters the multiple water course passages 57 in the drill bit base 59 (FIG. 1) and flows from the drill bit head 52, back to the surface through the well annulus (not illustrated). The drilling fluid is capable of removing particulate drilling fragments from the hydrocarbon-producing interval in the well as the drilling fluid flows between the drill bit head 52 and the interval, through the water course grooves 57 in the outer circumference of the drill bit head 52.

While the preferred embodiments of the invention have been described above, it will be recognized and understood that various modifications may be made in the invention and the appended claims are intended to cover all such modifications which may fall within the spirit and scope of the invention.

Having described the invention with the particularity set forth above, what is claimed is:

1. A sectional drive and coupling system for coupling a drive to an output, comprising at least two substantially linearly aligned segment housings; a drive segment provided in one end of each of said segment housings; a receiving segment provided in the opposite end of each of said segment housings; said receiving segment engaging said drive segment in adjacent ones of said segment housings in driving relationship; substantially aligned openings provided in said drive segment and said receiving segment; a bolt having a head seated on said drive segment in one of said segment housings; a shank extending from said head through said aligned openings in said drive segment and said receiving segment; a bore provided in said bolt for flowing a fluid through said segment housings; at least one spring provided on said shank at said head; and at least one nut threaded on said shank against said receiving segment in the adjacent one of said linearly aligned segment housings, for exerting a selected compressive force on said drive segment, said receiving segment and said spring, said drive segment comprising a drive segment base and a plurality of exterior splines tapering in spaced-apart relationship with respect to each other from said drive segment base, and said receiving segment comprising:

a receiving segment base and a plurality of interior splines extending from said receiving segment base, wherein said plurality of interior splines of said receiving segment engage said plurality of exterior splines of said drive segment in said adjacent ones of said segment housings, respectively, to interlock said drive segment and said receiving segment in nested relationship and connect the drive to the output.

2. The sectional drive and coupling system of claim 1 wherein said at least one spring comprises a plurality of belleville springs provided on said shank and comprising a spherical bearing provided in said receiving segment and a pair of washers provided on said shank on each side of said belleville springs.

3. The sectional drive and coupling system of claim 2 comprising a taper provided in one of said aligned openings in said drive segment.

4. The sectional drive and coupling system of claim 3 comprising a longitudinal bolt opening provided in said head and said shank of said bolt for interconnecting said substantially linearly aligned segment housings.

5. The sectional drive and coupling system of claim 4 wherein said plurality of exterior splines on said drive segment and said plurality of interior splines on said receiving segment comprises eight exterior splines and eight interior splines, respectively.

6. A sectional drive and coupling system for coupling a drive to an output, comprising at least two segment housings arranged in end-to-end relationship; a drive segment provided in one end of each of said segment housings; a receiving segment provided in the opposite end of each of said segment housings; and a connecting apparatus connecting said drive segment to said receiving segment, said drive segment comprising a drive segment base; a plurality of exterior splines tapering in spaced-apart relationship with respect to each other from said segment base; and an exterior spline seat defined between adjacent ones of said plurality of exterior splines; and said receiving segment comprising a receiving segment base; a plurality of interior splines extending from said receiving segment base and a plurality of interior spline seats defined between adjacent ones of said plurality of interior, respectively, wherein said plurality of interior spline seats of said receiving segment receives said plurality of exterior splines of said drive segment and said plurality of exterior splines of said drive segment engages said plurality of interior splines of said receiving segment, to interlock said drive segment and said receiving segment in nested relationship and connect the drive to the output; a taper provided in one of said aligned openings in said drive segment; a tapered opening provided in said drive segment and an opening provided in said receiving segment and wherein said tapered opening and said opening are substantially aligned and said connecting apparatus extends through said tapered opening and said opening and said drive segment and said receiving segment are connected in interlocking relationship with each other on said connecting apparatus in said adjacent ones of said segment housings, respectively wherein said connecting apparatus comprises a bolt having a head seated on said drive segment in one of said segment housings; a shank extending from said head through said tapered opening and said opening in said drive segment and said receiving segment respectively; at least one belleville spring provided on said shank at said head; a spherical bearing provided in said receiving segment; and at least one nut threaded on said shank against said spherical bearing in said receiving segment in the adjacent one of said linearly aligned segment housings, for exerting a selected compressive force on said drive segment, said receiving segment and said belleville spring.

7. The sectional drive and coupling system of claim 6 wherein said plurality of exterior splines on said drive segment and said plurality of interior splines on said receiving segment comprises eight exterior splines and eight interior splines, respectively.

8. The sectional drive and coupling system of claim 7 wherein said at least one belleville spring comprises a plurality of belleville springs provided on said shank and comprising a pair of washers provided on said shank on each side of said belleville springs.

9. A sectional drive and coupling system for coupling a drive to an output, comprising at least two segment housings arranged in end-to-end relationship; a drive segment provided in one end of each of said segment housings; and a tapered opening provided in said drive segment; a receiving segment provided in the opposite end of each of said segment housings; and a receiving segment opening provided in said receiving segment substantially in alignment with said tapered opening in said drive segment; and a connecting apparatus extending through said tapered opening and said receiving segment opening for connecting said drive segment to said receiving segment, said drive segment comprising a drive segment base; a plurality of exterior splines tapering in spaced-apart relationship with respect to each other from said segment base; and an exterior spline seat defined between adjacent ones of said plurality of exterior splines; and said receiving segment comprising a receiving segment base; a plurality of interior splines extending from said receiving segment base and a plurality of interior spline seats defined between adjacent ones of said plurality of interior splines, respectively, wherein said plurality of interior spline seats of said receiving segment receives said plurality of exterior splines of said drive segment and said plurality of exterior splines of said drive segment engages said plurality of interior splines of said receiving segment, to interlock said drive segment and said receiving segment in nested relationship and connect the drive to the output, wherein said connecting apparatus comprises a bolt having a head seated on said drive segment in one of said segment housings; a shank extending from said head through said tapered opening and said opening in said drive segment and said receiving segment respectively; at least one belleville spring provided on said shank at said head; a spherical bearing provided in said receiving segment; and at least one nut threaded on said shank against said spherical bearing in said receiving segment in the adjacent one of said linearly aligned segment housings, for exerting a selected compressive force on said drive segment, said receiving segment and said belleville spring.

10. The sectional drive and coupling system of claim 9 wherein said plurality of exterior splines on said drive segment and said plurality of interior splines on said receiving segment comprises eight exterior splines and eight interior splines, respectively.

* * * * *